US005121614A

United States Patent [19]

Weiss

[11] Patent Number: 5,121,614

[45] Date of Patent: Jun. 16, 1992

[54] JEWELRY ITEM HAVING ROTATABLE MULTI-SIDED DECORATION BARS REGULATED BY BIASING SPRINGS

[76] Inventor: Leon Weiss, 2792 Casiana Rd., Los Angeles, Calif. 90027

[21] Appl. No.: 685,136

[22] Filed: Apr. 15, 1991

[51] Int. Cl.[5] ..... A47C 25/00

[52] U.S. Cl. ..... 63/2

[58] Field of Search ..... 63/1.1, 2, 15, 20; 24/163 K; 40/473, 640

[56] References Cited

U.S. PATENT DOCUMENTS

| | | | |
|---|---|---|---|
| 1,553,198 | 9/1925 | Stern | 63/15 |
| 1,712,783 | 5/1929 | Alpern | 63/15 |
| 1,792,534 | 2/1931 | Germain | 63/15 |
| 1,972,205 | 9/1934 | Taylor . | |
| 2,221,926 | 11/1940 | Quant . | |
| 2,666,305 | 1/1954 | Wittmayer | 63/15 |
| 2,801,054 | 7/1957 | Bach . | |
| 2,913,794 | 11/1959 | Ostrower . | |
| 2,976,630 | 3/1961 | Montfort . | |
| 3,219,374 | 11/1965 | Snell | 292/252 |
| 3,304,638 | 2/1967 | Grandell . | |
| 3,959,989 | 6/1976 | Bhandia | 63/1.1 X |
| 4,581,791 | 4/1986 | Ong . | |
| 4,619,125 | 10/1986 | Choi . | |
| 4,638,580 | 1/1987 | Giannatti . | |
| 4,772,054 | 9/1988 | Schreiber et al. | 292/252 X |
| 4,977,757 | 12/1990 | Mesica et al. | 63/15 |

FOREIGN PATENT DOCUMENTS

| | | | |
|---|---|---|---|
| 363137 | 11/1922 | Fed. Rep. of Germany | 63/1.1 |
| 2139861 | 3/1972 | Fed. Rep. of Germany . | |
| 3826293 | 3/1989 | Fed. Rep. of Germany | 63/1.1 |
| 177422 | 8/1935 | Switzerland . | |
| 614064 | 10/1979 | Switzerland . | |

*Primary Examiner*—Renee S. Luebke
*Assistant Examiner*—Michael J. Milano
*Attorney, Agent, or Firm*—Thomas I. Rozsa

[57] ABSTRACT

The present invention is a jewelry item having in one embodiment a rotatable four-sided decoration bar whose rotation and orientation are regulated by biasing springs, including a frame and at least one elongated turning bar having decoration sides and at least one group of four detents located adjacent to one end of the at least one turning bar each corresponding to a respective decoration side, where the at least one turning bar is pivotally mounted on said frame. The present invention jewelry item further includes an arrangement for regulating the rotation of the at least one turning bar which includes at least one biasing spring and at least one regulating object engagable to a respective one of the detents on the at least one turning bar. The rotation of the at least one turning bar is halted when the at least one regulating object is engaged to a respective detent on the at least one turning bar. Since each of the decoration sides of the at least one turning bar is decorated differently, a user can rotate the at least one turning bar to have a desired side exhibited for matching the user's outfit.

15 Claims, 3 Drawing Sheets

Fig. 5.
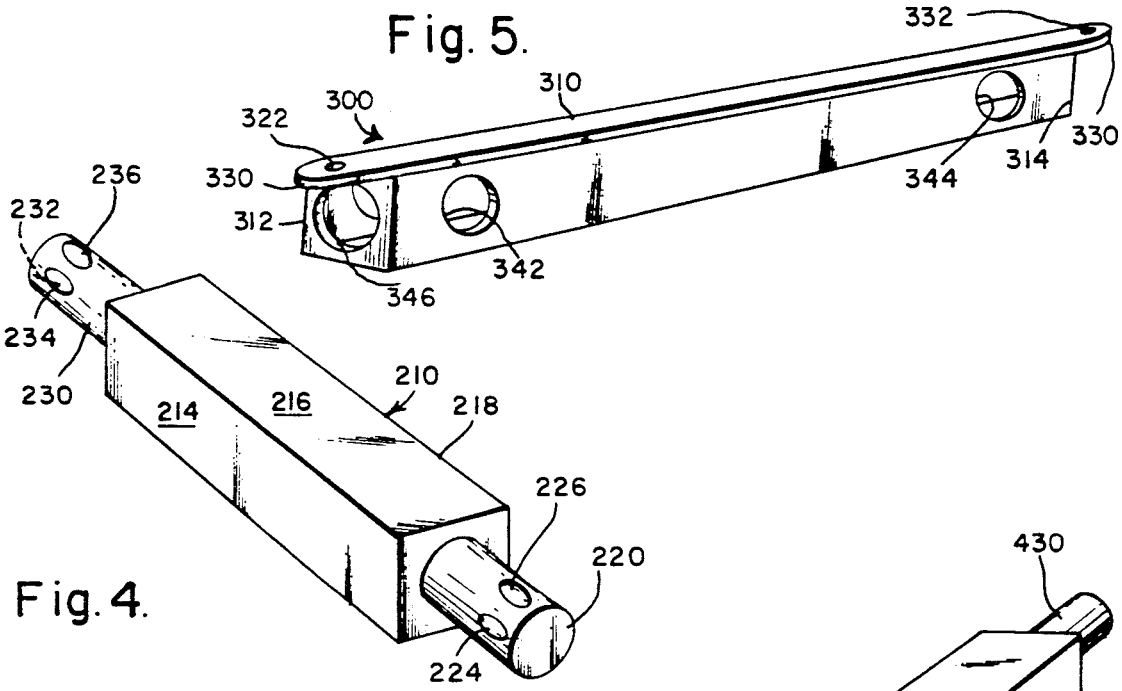
Fig. 4.
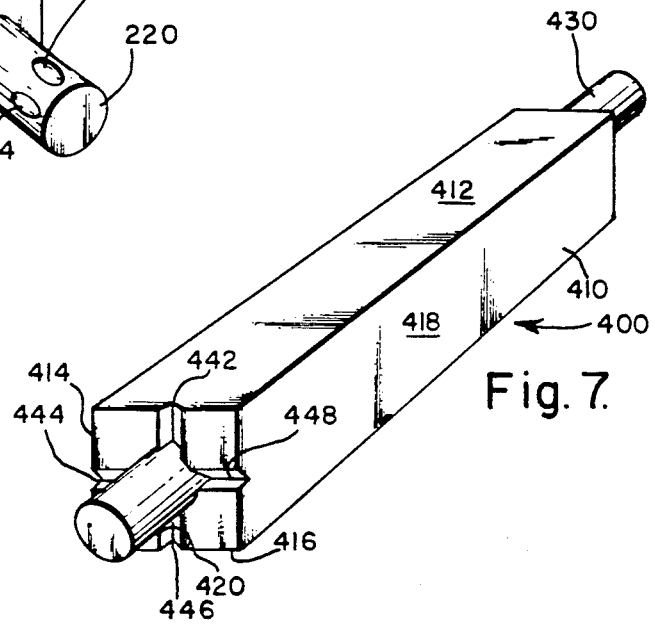
Fig. 7.
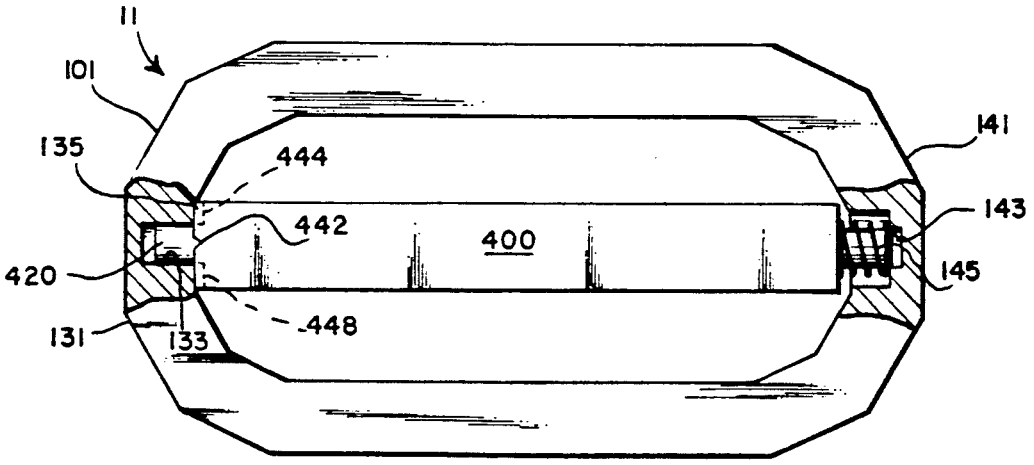
Fig. 6.

Fig. 8.
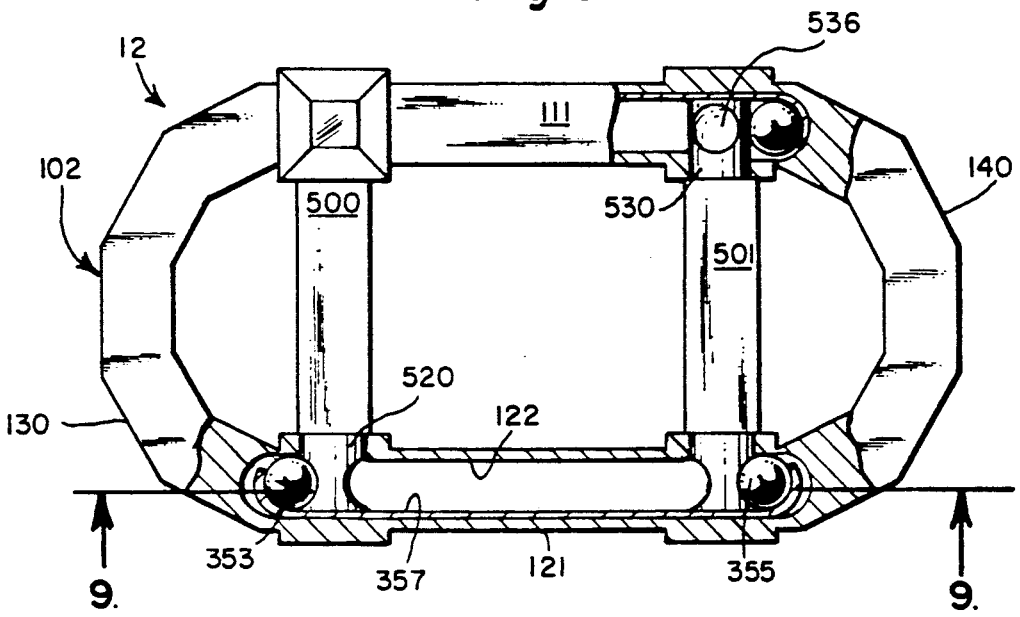
Fig. 9.
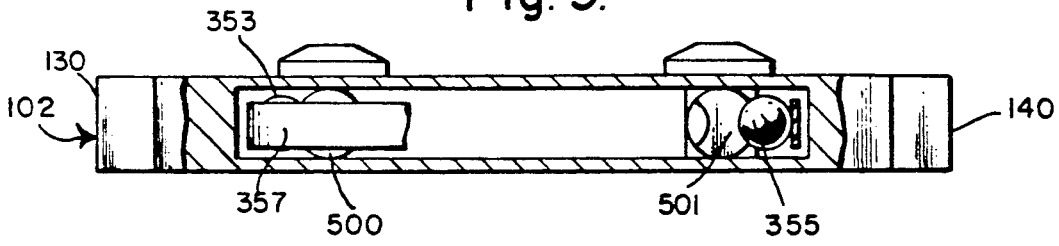
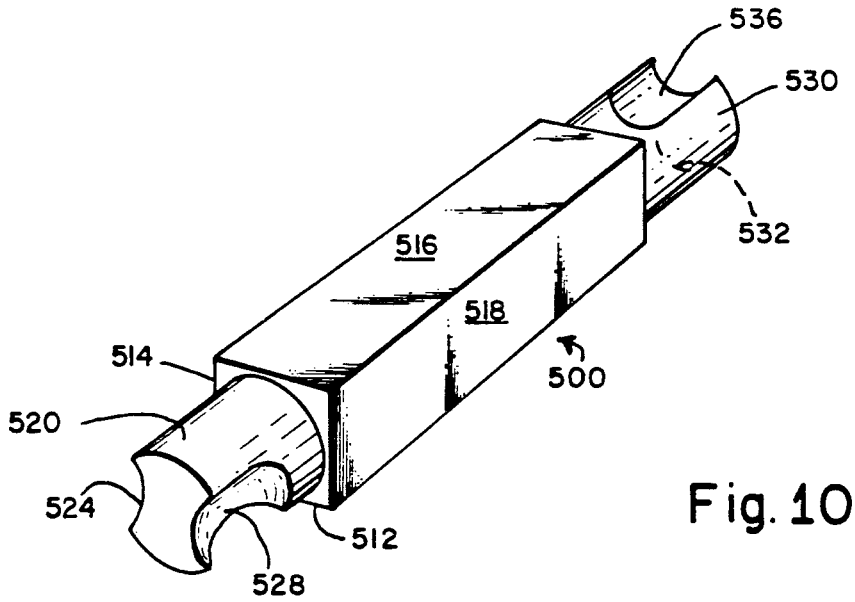
Fig. 10.

JEWELRY ITEM HAVING ROTATABLE MULTI-SIDED DECORATION BARS REGULATED BY BIASING SPRINGS

BACKGROUND OF THE INVENTION

1. Field of the Invention

The present invention relates to the field of jewelry items such as belt buckles, rings, cufflinks, tie tacks, and relates to the field of such jewelry items with rotatable bars.

2. Description of the Prior Art

The following prior art patents are relevant to the particular field of the present invention:

1. U.S. Pat. No. 1,972,205 issued to Taylor on Sep. 4, 1934 for "Indicating Device or The Like" (hereafter the "Taylor patent").

2. U.S. Pat. No. 2,221,926 issued to Quant on Nov. 19, 1940 for "Selective Character Bearing Device" (hereafter the "Quant patent").

3. U.S. Pat. No. 2,801,054 issued to Bach on Jul. 30, 1957 for "Mechanical Tally" (hereafter the "Bach patent").

4. U.S. Pat. No. 2,913,794 issued to Ostrower on Nov. 24, 1959 for "Interchangeable Belt and Stop Buckle Combination" (hereafter the "Ostrower patent").

5. U.S. Pat. No. 2,976,630 issued to Montfort on Mar. 28, 1961 for "Key-Ring-Trinket" (hereafter the "Montfort patent").

6. U.S. Pat. No. 3,304,638 issued to Grandell et al. on Feb. 21, 1967 for "Activated Changeable Advertising Sign" (hereafter the "Grandell patent").

7. U.S. Pat. No. 4,581,791 issued to Ong on Apr. 15, 1986 for "Buckle" (hereafter the "Ong patent").

8. U.S. Pat. No. 4,619,125 issued to Choi on Oct. 28, 1986 for "Key Holder With Changeable Indicia Display" (hereafter the "Choi patent").

9. U.S. Pat. No. 4,638,580 issued to Giannetti et al on Jan. 27, 1987 for "Publicity Board With Rotating Prismatic Members" (hereafter the "Giannetti patent").

10. Swiss Patent No. 177,422 issued to Ziegler on Aug. 1, 1935 (hereafter the "Swiss patent ('422)").

11. German Patent No. 2,139,851 issued to Breguet on Mar. 30, 1972 (hereafter the "German patent").

12. Swiss Patent No. 614,064 issued to Utiger on Oct. 31, 1979 (hereafter the "Swiss patent ('064)").

The Taylor patent discloses an indicating device having a series of rings 19 mounted on a sleeve 11. The periphery of each ring 19 is divided by intermediate exterior radial notches 21 into a plurality of segments 22 each decorated differently. A line of aligned segments of the plurality of rings 19 is displayed through an elongated window opening 28 of a tubular casing 23 which surrounds the plurality of rings 19. The casing 23 has a series of openings 30 containing a spring-pressed ball 31 engageable with the notches 21 of the respective rings 19 for yieldably holding the rings 19 in proper position with respect to the window opening 28.

The Quant patent discloses a selective character bearing device having channel shaped holder 10, a locking plate 14 and several character pieces 17. The locking plate 16 has several lateral spring locking fingers for holding the character pieces in position.

The Bach patent discloses a mechanical golf tally having a multiplicity of hollow disks 24 and hollow washers 32 mounted on a stem and stacked alternatively. Each disk 24 has several recesses 25 at its bottom, and each washer 32 has a rounded projection 36 at its top. Washers 32 are not rotatable and disks 24 are, and the rotation of an individual disk 24 is regulated by the washer 32 underneath as the projection 36 of the washer 24 is engaged to one of the recesses 25 of the disk 24. A pair of washer springs 46 and 48 are placed at the top and the bottom of the pile of disks 24 and washer 32 to press them together. The design of the Bach patent is similar to that of the Taylor patent but without the biasing coil springs.

The Ostrower patent discloses an interchangeable belt and stop buckle combination having a buckle A and a belt F. Buckle A has a frame with double loop structure B for receiving the anchoring end J of belt F, and a prong E for locking the free end G of belt F. The Ostrower patent is cited as being of general interest as disclosing a quick exchangeable belt and buckle arrangement. The Ostrower patent buckle has a fixed oblique bar member 13 for decoration.

The Montfort patent discloses a key-ring-trinket having a similar structure as the Taylor patent. The Montfort patent has a series of rings 3 mounted on a tubular axle 4 and contained in a housing 1. A special segment of a ring 3 may be aligned to a window 2 of housing 1 for viewing. Each ring 3 has tenons 6 at one side and recesses 8 at the other side. When positioned next to each other and biased by a coil spring at one end of housing 1, the rotation of an individual ring 3 is regulated by the tenons 6 of the next ring engaged to the recesses 8 of the individual ring 3.

The Grandell patent discloses an activated changeable advertising sign having a multiplicity of triple-sided rotatable bars 16 driven by an electrical motor 38.

The Ong patent discloses a two part buckle having an attachment part 1 and a connecting part 3 rotatably connected by a screw 12 which is in turn biased by a coil spring 13. Attachment part 1 is affixed to one end of a belt and connecting part 2 receives the other end of the belt. Connecting part 2 is a hollow frame having a rotatable double-sided badge holder 7. The decorating badge holder 7 is a hollow bar mounted on another hollow shaft 11 pivoted on the frame of connecting part 3, and the rotation of the badge holder is not regulated by spring 13.

The Choi patent discloses a key holder with changeable indicia display. The positions of the indicia bearing elements of the Choi patent are secured by threaded screw members.

The Giannetti patent discloses an advertising board with rotating prismatic members having structures similar to the Grandell patent.

The Swiss patent ('422) discloses a device including a multiplicity of displaying rings 2 each having several side 10 biased by a spring 9.

The German patent is a device including a multiplicity of displaying rings 11 mounted on a shaft 15 which has many columns of recesses 19. Each ring has an inner chamber for housing a biasing spring 24 and small ball 26. The rotation of an individual ring 11 can be controlled by the spring-biased ball 26 when it is engaged into the recesses 19 on the periphery of shaft 15.

The Swiss patent ('064) discloses an advertising device having two spaced apart rows of triple-sided rods 4 each attached with an endless display web 14. The surface of each web has a number of picture strips 15.

Most of the rotating objects in the prior art are hollow objects such as rings, disks or washers mounted on a central shaft. None of the prior art patents has disclosed a rotatable bar mounted to a frame at its opposite ends without an extra shaft. In addition, none of the prior art patents has disclosed the idea of using a single biasing spring to support two small balls at its opposite ends for regulating the rotation of the rotatable objects.

SUMMARY OF THE PRESENT INVENTION

The present invention is jewelry items such as a jewelry belt buckle having rotatable four-sided decoration bars whose rotation and orientation are regulated by biasing springs. The concept of the present invention is to provide a matching color coordinate set of jewelry including a belt buckle, tie tack, cufflinks, shoe buckle and ring which are color coordinated to the outfit the person is wearing.

It is known that many people prefer to have color coordinated accessories, such as belt buckles, for their outfits. There are several different types of double-sided belt buckles currently available on the market which are decorated differently on their opposite sides, so that people can match one side of the buckle with one set of outfit and the other side with another outfit. However, these belt buckles are all limited to only two different sides which are often not enough. On the other hand, there are many various types of changeable display devices which typically have a multiplicity of rotatable hollow wheels mounted on a common shaft and pressed by biasing springs. The outer periphery of the rotatable wheels is divided into many small segments each marked differently. Since users usually want to view certain aligned marks only, the display devices often include a cover case having a window opening for showing certain aligned marks while hiding all other marks from the user's view.

It has been discovered, according to the present invention, that if a belt buckle, shoe buckle, tie tack, cufflinks and ring each have at least one decoration bar that is multi-sided, then when one side of the decoration bar on each item is turned to face the front and can be seen, it is not necessary to use a cover case to hide the other three sides from view, since the opposite side is facing back. and the other two sides are vertical to the viewer.

It has also been discovered, according to the present invention, that if each end of the decoration bar has a respective short round shaft such that the decoration bar can be pivotally mounted at its two ends and thus rotatable, then it is not necessary to make an axial hollow through the decoration bar and mount it on a separate elongated shaft.

It has further been discovered, according to the present invention, that if at the end of the decoration bar there are a number of detents such as four, each corresponding to the number of sides of the bar, such as four and a small ball is biased by a spring and engaged to an individual detent, then the rotation and the orientation of the decoration bar are regulated.

It has additionally been discovered, according to the present invention, that if two decoration bars are symmetrically mounted on a frame of an item such as a belt buckle, then a single spring can be used to simultaneously support two small balls at its two ends such that both small balls are biased by the single spring and engaged in the detents at the end of the two decoration bars respectively.

It has further been discovered, according to the present invention, that if a jewelry device has a frame structure, then the rotatable multi-sided decoration bar can be utilized.

It is therefore an object of the present invention to provide jewelry items which utilize a decoration bar that has a multiplicity of sides, with each side having different colors or ornaments, and when one side is turned to face the front and can be viewed by a viewer, the other sides are out of sight without the use of an extra case.

It is an additional object of the present invention to provide jewelry items which utilize a decoration bar that has two short round shafts at its two ends respectively, to pivotally mount the decoration bar at its two ends, and eliminate the need for having a through axial hollow in the decoration bar and using an extra shaft.

It is a further object of the present invention to provide a jewelry items which utilize a decoration bar having a multiplicity of detents at each end with a given detent corresponding to a selected side of the bar, and a small ball biased by a spring and engaged to an individual detent, for regulating the rotation and the orientation of the decoration bar.

It is an additional object of the present invention to provide jewelry items buckles which utilize two symmetrically mounted decoration bars, and a single spring simultaneously supporting two small balls at its tow ends for engaging both small balls in the detents at the end of the two decoration bars respectively.

It is also an object of the present invention to provide various jewelry devices, in addition to the belt buckle, such as tie tacks, shoe buckles, cufflinks, and so on, which utilize the rotatable multi-sided decoration bars and spring biased rotation and orientation regulating members, so people can have most of their accessories match their outfits in an almost limitless way.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 4 is a perspective view of one bearing bar of the present invention.

FIG. 5 is a perspective view of one turning bar of the present invention.

FIG. 6 is a top plan view of one alternative embodiment of the present invention incorporated in a jewelry belt buckle, shown in partial cross-section.

FIG. 7 is a perspective view of the turning bar of the alternative embodiment of the present invention.

FIG. 8 is a bottom plan view of another alternative embodiment of the present invention incorporated in a jewelry belt buckle, shown in partial cross-section.

FIG. 9 is a side view of the other alternative embodiment of the present invention incorporated in a jewelry belt buckle, in FIG. 8, shown in partial cross-section.

FIG. 10 is a perspective view of one bearing bar of the other alternative embodiment of the alternative embodiment of the present invention shown in FIG. 8.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
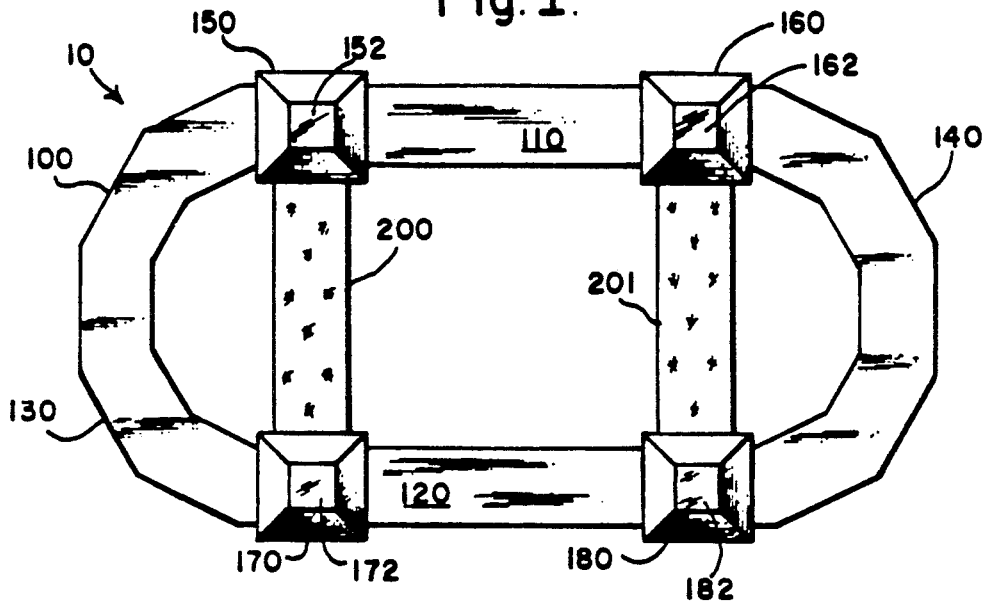
FIG. 1 is a top plan view of the present invention incorporated in a jewelry belt buckle.

Referring to FIG. 1, there is shown at 10 a top view of the present invention jewelry belt buckle having rotatable four-sided decoration bars regulated by biasing springs. For purposes of this discussion, a jewelry belt buckle is illustrated. It will be appreciated that the same structure can be incorporated into a ring, tie tack, cufflinks, shoe buckles and other jewelry items to form a jewelry ensemble. Jewelry items such as belt buckle 10 comprises a hollow frame 100. Hollow frame 100 may be made of any suitable material such as metal, plastic and wood. Hollow frame 100 has a first longitudinal side portion 110, a second longitudinal side portion 120, a first transversal end portion 130 and a second transversal end portion 140. First and second longitudinal side portions 110 and 120 are both straight and parallel to each other. First and second transversal end portions 130 and 140 are both arcuate. There may be decorations on top of frame 100. There are four junctures, 150, 160, 170 and 180, of first and second side portions 110 and 120 and first and second end portions 130 and 140 respectively. There may be decorations on top of these junctures too. As shown in FIG. 1 for example, there are stones 152, 162, 172 and 182 mounted on top of junctures 150, 160, 170 and 180 respectively. Stones 152, 162, 172 and 182 may be diamonds, rubies, emeralds and sapphires, or the like. Between junctures 150 and 170 there is a first transversal turning bar 200, and between junctures 160 and 180 there is a second transversal turning bar 201 which is identical to first turning bar 200. First and second transversal turning bars 200 and 201 are both straight and parallel to each other.

Figure 2:
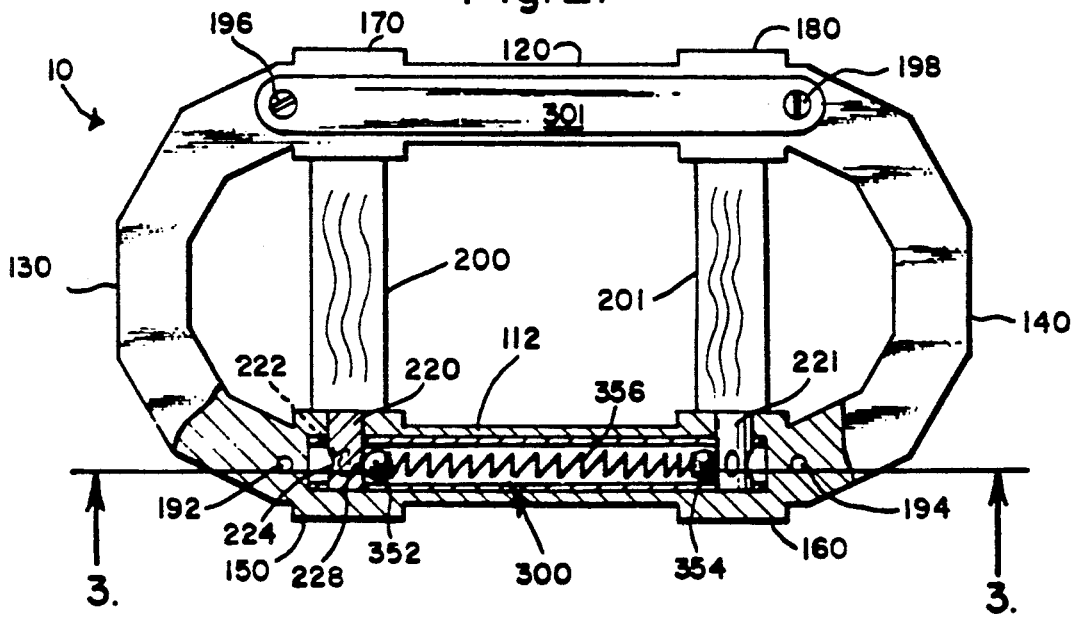
FIG. 2 is a bottom plan view of the present invention incorporated in a jewelry belt buckle, shown in partial cross-section.

FIG. 2 is a bottom view of the present invention jewelry belt buckle 10 with sectional details. It can be seen from the bottom view that jewelry belt buckle 10 further comprises a first longitudinal bearing bar 300 and a second longitudinal bearing bar 301. It can be seen from the sectional detailed view that, at the bottom of first longitudinal side portion 110 of frame 100 there is an elongated groove 112 extending through its entire length from juncture 150 to juncture 160 for receiving first bearing bar 300. First bearing bar 300 is fastened to frame 100 by two fastening screws 192 and 194. This arrangement is identical for second longitudinal side portion 120 of frame 100 and second longitudinal bearing bar 301, where second bearing bar 301 is adapted in an elongated groove at the bottom of second longitudinal side portion 120 of frame 100 and fastened to frame 100 by two fastening screws 196 and 198.

Referring to FIG. 4, there is shown at 200 the first transversal turning bar of the present invention jewelry items incorporated into belt buckle 10. Second transversal turning bar 201 is identical to first transversal turning bar 200. First transversal turning bar 200 has an elongated rectangular central portion 210, a first short cylindrical shaft 220 and a second short cylindrical end portion 230. Elongated central portion 210 has four decoration sides 212, 214, 216 and 218 each colored or decorated differently with jewelry such as diamonds or gemstones. First end portion 220 has four detents 222, 224, 226 and 228 on its periphery positioned according to the four decoration sides 212, 214, 216 and 218 of central portion 210 respectively. Second end portion 230 also has four detents 232, 234, 236 and 238 on its periphery positioned according to the four decoration sides 212, 214, 216 and 218 of central portion 210 respectively. In other words, decoration side 212 of central portion 210, detent 222 of first end portion 220 and detent 232 of second end portion 230 are all facing to a same first direction; decoration side 214 of central portion 210, detent 224 of first end portion 220 and detent 234 of second end portion 230 are all facing the same second direction; decoration side 216 of central portion 210, detent 226 of first end portion 220 and detent 236 of second end portion 230 are all facing the same third direction; and decoration side 218 of central portion 210, detent 228 of first end portion 220 and detent 238 of second end portion 230 are all facing to a same fourth direction. The respective angles between the four directions are the same: ninety degrees (90°).

Referring to FIG. 5, there is shown at 300 the first longitudinal bearing bar of the present invention jewelry belt buckle 10. Second longitudinal bearing bar 301 is identical to first longitudinal bearing bar 300. First longitudinal bearing bar 300 has a longitudinally elongated central body 310 having a first end 312 and second end 314, a first mounting ear 320 extending from first end 312 of central body 310 and having a small opening 322 for receiving a mounting screw, and second mounting ear 330 extending from second end 314 of central body 310 and having a small opening 332 for receiving a mounting screw. Longitudinally elongated central body 310 of first bearing bar 300 has a first transversal end opening 342 near its first end 312, a second transversal end opening 344 near its second end 314, and a longitudinal central chamber 346 running from its first end 312 to its second end 314.

Figure 3:
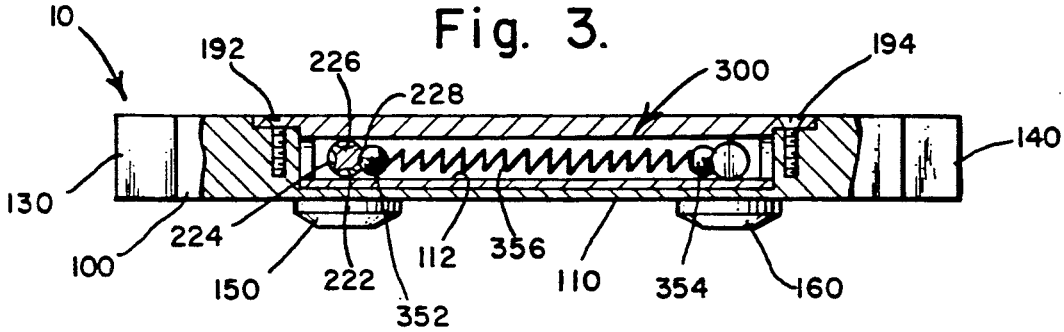
FIG. 3 is a cross-sectional view taken along line 3—3 of FIG. 2.

Referring to FIGS. 2 and 3, as illustrated, a first pair of regulating balls 352 and 354, and a first biasing spring 356 are placed inside longitudinal central chamber 346 of first bearing bar 300. First end portion 220 of first turning bar 200 is pivotally accommodated by first transversal end opening 342 of first bearing bar 300, and symmetrically, first end portion 221 of second turning bar 201 is pivotally accommodated by second transversal end opening 344 of first bearing bar 300. Identical to this arrangement but not shown in the figures in sectional details, a second pair of regulating balls and a second biasing spring are placed inside a longitudinal central chamber of second bearing bar 301, second end portion 230 of first turning bar 200 is pivotally accommodated by a first transversal end opening of second bearing bar 301, and second end portion 231 of second turning bar 201 is pivotally accommodated by a second transversal end opening of second bearing bar 301.

When the present invention incorporated into a jewelry belt buckle 10 is assembled: (a) first biasing spring 356 is placed into central chamber 346 of first bearing bar 300 with first pair of regulating balls 352 and 354 such that first pair of regulating balls 352 and 354 are biased by the two opposite ends of first biasing spring 356; (b) first end portion 210 of first turning bar 200 is inserted into first end opening 342 of first bearing bar 300; and (c) first end portion 221 of second turning bar 201 is inserted into second end opening 344 of first bearing bar 300; (d) such that first pair of regulating balls 352 and 354 biased by first biasing spring 356 can engage to certain detents at respective first end portions 220 and 221 of first and second turning bars 200 and 201; and (e) central body 310 of first bearing bar 300 is placed into groove 112 at the bottom of first longitudinal side portion 110 of frame 100, and secured to frame 100 by two mounting screws 192 and 194 through openings 322 and 332 respectively at first and second mounting ear 320 and 330.

Identical to this arrangement but not shown in the figures in sectional details: (a) the second biasing spring is placed into the central chamber of second bearing bar 301 with the second pair of regulating balls such that the second pair of regulating balls are biased by the two opposite ends of the second biasing spring; (b) second end portion 231 of first turning bar 200 is inserted into the first end opening of second bearing bar 301; and (c) second end portion 231 of second turning bar 201 is inserted into the second end opening of second bearing bar 301; (d) such that the second pair of regulating balls biased by the second biasing spring can engage to certain detents at the respective second end portions 230 and 231 of first and second turning bars 200 and 201; and (e) the central body of second bearing bar 301 is placed into the groove at bottom of second longitudinal side portion 120 of frame 100, and secured to frame 100 by two mounting screws 196 and 198.

When the jewelry belt buckle is completely assembled, first and second turning bars 200 and 201 are parallel to each other transversely and cross over frame 100. Each turning bar can be individually rotated manually, and the orientation of its four differently decorated sides can be secured by the engagement of the regulating balls biased by the respective coil springs. Each time a turning bar is rotated by ninety degrees (90°), the respective regulating balls will engage to the next detents at the end portions of the turning bar, such that the orientation of the turning bar is secured again. One can choose different sides of the turning bars to match different outfits without changing the belt buckle.

In FIG. 6 there is shown at 11 an alternative embodiment of the present invention jewelry belt buckle. The alternative embodiment 11 comprises a frame 101 similar to frame 100 as previously described, however, the two transversal turning bars have been replaced by a single longitudinal turning bar 400.

FIG. 7 is a perspective view of longitudinal turning bar 400 of alternative embodiment 11 Longitudinal turning bar 400 has an elongated rectangular central portion 410, a first short cylindrical end portion 420 and a second short cylindrical end portion 430. Elongated central portion 410 has four decoration sides 412, 414, 416 and 418 each colored or decorated differently with jewelry such as diamonds or gemstones. There are four detents 442, 444, 446 and 448 located at the juncture of central portion 410 and first end portion 420 facing the longitudinal direction. The four detents 442, 444, 446 and 448 are positioned according to the four decoration sides 442, 444, 446 and 448 of central portion 410 respectively.

Referring to FIG. 6 again, there is shown that the first arcuate portion 131 of frame 101 has a first opening 133 for adapting first end portion 420 of longitudinal turning bar 400, and a small protruding object 135 for engaging to one of the four detents on longitudinal turning bar 400. There is also shown that the second arcuate portion 141 of frame 101 has a second opening 14 for adapting second end portion 430 of longitudinal turning bar 400, and part of second opening 143 is widened for adapting a biasing spring 145 wound on second end portion 430 of longitudinal turning bar 400. When assembled, turning bar 400 can be rotated for having a desired side faced up, and this desired orientation is automatically locked because biasing spring 145 is pressing turning bar 400 towards first arcuate portion 131 of frame 101 such that small protruding object 135 will engage to a respective detent near first end portion 420 of turning bar 400.

Another alternative embodiment of the present invention jewelry belt buckle is shown in FIGS. 8–10. FIG. 8 is a bottom view of the other alternative embodiment of the present invention incorporated in a jewelry belt buckle, shown in partial cross-section; FIG. 9 is a side view of the other alternative embodiment of the present invention incorporated in a jewelry belt buckle, shown in partial cross-section; and FIG. 10 is a perspective view of the turning bar of this alternative embodiment of the present invention.

Referring to FIGS. 8 and 9, there is shown at 12 a jewelry belt buckle similar to the one shown in FIG. 1. Jewelry belt buckle 12 has a hollow frame 102 having a first longitudinal side portion 111, a second longitudinal side portion 121, a first transversal end portion 130 and a second transversal end portion 140. Side portions 111 and 121 each have a central hollow chamber. Shown in FIG. 1, there are a pair of small balls 353 and 357 placed inside the central hollow chamber 122 of side portion 120 of frame 102 along with and biased by a "U"-shaped biasing spring 357. Inside side portion 111 of frame 102 there is a similar arrangement. A pair of transversal turning bars 500 and 501 are mounted to frame 102 and their rotations are regulated by the small regulating balls. Turning bar 500 is shown in detail in FIG. 10. It is similar to turning bar 200 shown in FIG. 4. It has a central portion 510 and two end portions 520 and 530. Central portion 510 has four decorated sides 512, 514, 516 and 518. However there are onlty two detents at each of its end portions. At its first end portion 520 there are two oppositely disposed detents 524 and 528 respectively facing the same directions as sides 514 and 518 of the central portion 510. At its second end portion 530 there are two oppositely disposed detents 532 and 536 respectively facing the same directions as sides 512 and 516 of the central portion 510. The pair of detents 532 and 535 at the second end portion 530 are offset by 90 degrees with the pair of detents 524 and 528 at the first end portion 520. After being assembled onto frame 102, turning bar 500 can be rotated and automatically locked when one of the four sides of its central portion is facing up. If it is locked by a regulating ball inside said portion 111 of frame 102, then it will be locked alternatively by a regulating ball inside side portion 121 after being rotated by ninety degree. Turning bar 501 has the same feature and arrangement as turning bar 500. This embodiment makes it easier to manufacture the turning bars since there are half as many detents on the end portions of the turning bars.

The essential feature of the present invention is the rotatable decoration bars regulated by biasing springs where each rotatable bar has a multiplicity of sides such as four sides which are decorated differently. At the ends of the rotatable bar there are four detents corresponding to its four sides. When the decoration bar is rotted to a certain orientation for exhibiting a desired side. the rotation of the decoration bar can be locked automatically by having a small protruding object engaged to a corresponding detent because of the existing force of a biasing spring. The same feature may be utilized in numerous other accessories, such as tie tacks, shoe buckles, cufflinks, rings etc.

Defined in detail, the present invention is a jewelry item comprising: (a) a frame having a first elongated straight longitudinal side portion, a second elongated straight longitudinal side portion and two arcuate transversal end portions; (b) a first elongated straight longitudinal bearing bar and a second elongated straight longitudinal bearing bar each having a first end and a second end, a first short transversal chamber adjacent to the first end, and a second short transversal chamber adjacent to the second end, and an elongated straight longitudinal chamber extending from the first transversal chamber to the second transversal chambers; (c) a first elongated straight transversal turning bar and a second elongated straight transversal turning bar each having an elongated rectangular central portion with four decoration sides, a first short cylindrical end portion and a second short cylindrical end portion each further having four side detents each corresponding to a respective decoration side of the central portion; (d) a first elongated biasing spring placed between a first pair of small regulating balls all contained inside the longitudinal chamber of the first bearing bar, and a second elongated biasing spring placed between a second pair of small regulating balls all contained inside the longitudinal chamber of the second bearing bar; (e) the first end portions of the first and second turning bars inserted into the first and second transversal chambers of the first bearing bar respectively and contacting the first pair of regulating balls biased by the first biasing spring, and the second end portions of the first and second turning bars inserted into the first and second transversal chambers of the second bearing bar respectively and contacting the second pair of regulating balls biased by the second biasing spring; and (f) means for mounting the first and second bearing bars to the frame adjacent to the first and second side portions of the frame respectively; (g) whereby each turning bar can be individually rotted, and the rotation of an individual turning bar is halted when respective regulating balls are engaged to respective detents at the first and second end portions of the individual turning bar.

In the preferred embodiment of the present invention defined in detail: (a) the central portions of the first and second turning bars each has a first decoration side, a second decoration side, a third decoration side and a fourth decoration side, the respective first decoration sides of the first and second turning bars are decorated similarly, the respective second decoration sides of the first and second turning bars are decorated similarly, the respective third decoration sides of the first and second turning bars are decorated similarly, and the respective fourth decoration sides of the first and second turning bars are decorated similarly, so that a user can rotate the first and second turning bars to have a similar pair of sides exhibited for matching the user's outfit; (b) the four decoration sides of the central portions of the first and second turning bars have four different types of colors respectively; (c) the four decoration sides of the central portions of the first and second turning bars are decorated with four different kinds of gemstones respectively; and (d) the frame is decorated with gemstones at the junctures of the first side portion and the first and second end portions and the junctures of the second side portion and the first and second end portions.

Furthermore, in the preferred embodiment of the present invention defined in detail, the means for mounting the first and second bearing bars to the frame comprises: (a) a first elongated straight longitudinal groove located on the first elongated straight longitudinal side portion of the frame for accommodating the first bearing bar, and a second elongated straight longitudinal groove located on the second elongated straight longitudinal side portion of the frame for accommodating the second bearing bar; (b) a first pair of small openings having inner screw threads located on the frame adjacent to each end of the first elongated groove respectively for receiving a first pair of mounting screws, and a second pair of small openings having inner screw threads located on the frame adjacent to each end of the second elongated groove respectively for receiving a second pair of mounting screws; and (c) a first pair of mounting ears extending respectively from the first and second ends of the first bearing bar each having a small opening, and a second pair of mounting ears extending respectively from the first and second ends of the second bearing bar each having a small opening; (d) whereby when the first bearing bar is adapted into the first groove on the frame, the small openings on the first and second mounting ears of the first bearing bar are aligned with the first pair of small openings on the frame, to thereby receive the first pair of mounting screws for mounting the first bearing bar to the frame, and when the second bearing bar is adapted into the second groove on the frame, the small openings on the first and second mounting bars of the second bearing bar are aligned with the second pair of small openings on the frame, to thereby receive the second pair of mounting screws for mounting the second bearing bar to the frame.

Defined alternatively in detail, the present invention is a jewelry item comprising: (a) a frame having a first arcuate transversal end portion and a second arcuate transversal end portion each having a central opening, and two elongated straight longitudinal side portions, the first arcuate end portion further having a small projection adjacent to its central opening; (b) an elongated straight longitudinal turning bar having an elongated rectangular central portion with four decoration sides, a first short cylindrical end portion and a second short cylindrical end portion, and four end detents located adjacent to the juncture of the central portion and the first end portion each corresponding to a respective decoration side of the central portion; and (c) the first and second end portions of the longitudinal turning bar inserted into the central openings of the first and second arcuate end portions of the frame respectively with a biasing spring wound on the second end portion of the turning bar for biasing the turning bar towards the first arcuate end portion of the frame such that the projection on the first arcuate end portion of the frame is engageable to respective end detents on the turning bar; (d) whereby the turning bar can be rotted, and the rotation of the turning bar is halted when the small projection on the first arcuate end portion of the frame is engaged to a respective detent adjacent to the first end portion of the turning bar.

In the alternative embodiment of the present invention: (a) each of the decoration sides of the central portion of the turning bar is decorated differently so that a user can rotate the turning bars to have a desired side exhibited for matching the user's outfit; (b) the four decoration sides of the central portion of the turning bar have four different types of colors respectively; (c) the four decoration sides of the central portion of the turning bar are decorated with four different kinds of gemstones respectively; (d) the frame is decorated with gemstones at the junctures of the first end portion and the two side portions and the junctures of the second end portion and the two side portions; and (d) the central opening of the second arcuate end portion is partially widened for accommodating the biasing spring.

Defined further alternatively in detail, the present invention is a jewelry item comprising: (a) a frame having two arcuate transversal end portions, and a first elongated straight longitudinal side portion and a second elongated straight longitudinal side portion each having a first end and a second end, a first short transversal chamber adjacent to the first end, a second short transversal chamber adjacent to the second end, and an elongated straight longitudinal chamber extending from the first transversal chamber to the second transversal chamber; (b) a first elongated straight transversal turning bar and a second elongated straight transversal turning bar each having an elongated rectangular central portion with four decoration sides, a first short cylindrical end portion and a second short cylindrical end portion each further having a pair of oppositely disposed side detents corresponding to a respective pair of oppositely disposed decoration sides of the central portion, where the pair of detents at the first end portion are offset with the pair of detents at the second end portion by ninety degrees; (c) a first pair of small regulating balls and a first elongated "U"-shaped biasing spring contained inside said longitudinal hollow chamber of said first side portion of said frame, and a second pair of small regulating balls and a second elongated "U"-shaped biasing spring contained inside said longitudinal hollow chamber of said second side portion of said frame; and (d) said first end portions of said first and second turning bars inserted into said first and second transversal chambers of said first side portion of said frame respectively and contacting said first pair of regulating balls biased by said first biasing spring, and said second end portions of said first and second turning bars inserted into said first and second transversal chambers of said second side portion of said frame respectively and contacting said second pair of regulating balls biased by said second biasing spring; (e) whereby each turning bar can be individually rotated, and the rotation of an individual turning bar is halted when respective regulating balls are engaged to respective detents at the first and second end portions of the individual turning bar.

Defined more broadly, the present invention is a jewelry item comprising: (a) a frame; (b) at least one elongated turning bar having four decoration sides and at least one group of four detents located adjacent to one end of the at least one turning bar each corresponding to a respective decoration side; (c) the at least one turning bar pivotally mounted on the frame; and (d) means for regulating the rotation of the at least one turing bar including at least one biasing spring and at least one regulating object engageable to a respective one of the detents on the at least one turning bar; (e) whereby the rotation of the at least one turning bar is halted when the at least one regulating object is engaged to a respective detent on the at least one turning bar.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent monopoly to be granted.

What is claimed is:

1. A jewelry item comprising:

a. a frame having a first elongated straight longitudinal side portion, a second elongated straight longitudinal side portion and two arcuate transversal end portions;

b. a first elongated straight longitudinal bearing bar and a second elongated straight longitudinal bearing bar each having a first end and a second end, a first short transversal chamber adjacent to the first end, a second short transversal chamber adjacent to the second end, and an elongated straight longitudinal chamber extending from the first transversal chamber to the second transversal chamber;

c. a first elongated straight transversal turning bar and a second elongated straight transversal turning bar each having an elongated rectangular central portion with four decoration sides, a first short cylindrical end portion and a second short cylindrical end portion each further having four side detents each corresponding to a respective decoration side of the central portion;

d. a first elongated biasing spring placed between a first pair of small regulating balls all contained inside said longitudinal chamber of said first bearing bar, and a second elongated biasing spring placed between a second pair of small regulating balls all contained inside said longitudinal chamber of said second bearing bar;

e. said first end portions of said first and second turning bars inserted into said first and second transversal chambers of said first bearing bar respectively and contacting said first pair of regulating balls biased by said first biasing spring, and said second end portions of said first and second turning bars inserted into said first and second transversal chambers of said second bearing bar respectively and contacting said second pair of regulating balls biased by said second biasing spring; and f. means for mounting said first and second bearing bars to said frame adjacent to said first and second side portions of said frame respectively;

g. whereby each turning bar can be individually rotated, and the rotation of an individual turning bar is halted when respective regulating balls are engaged to respective detents at the first and second end portions of the individual turning bar.

2. A jewelry item as described in claim 1 wherein said central portions of said first and second turning bars each has a first decoration side, a second decoration side, a third decoration side and a fourth decoration side, the respective first decoration sides of said first and second turning bars are decorated similarly, the respective second decoration sides of said first and second turning bars are decorated similarly, at the respective third decoration sides of said first and second turning bars are decorated similarly, and the respective fourth decoration sides of said first and second turning bars are decorated similarly, so that a user can rotate said first and second turning bars to have a similar pair of sides exhibited for matching the user's outfit.

3. A jewelry item as defined in claim 2 wherein said four decoration sides of said central portions of said first and second turning bars have four different types of colors respectively.

4. A jewelry item as defined in claim 2 wherein said four decoration sides of said central portions of said first and second turning bars are decorated with four different kinds of gemstones respectively.

5. A jewelry item as defined in claim 1 wherein said frame is decorated with gemstones at the junctures of said first side portion and said first and second end portions and the junctures of said second side portion and said first and second end portions.

6. The jewelry item as defined in claim 1 wherein said means for mounting said first and second bearing bars to said frame comprises:

a. a first elongated straight longitudinal groove located on said first elongated straight longitudinal side portion of said frame for accommodating said first bearing bar, and a second elongated straight longitudinal groove located on said second elongated straight longitudinal side portion of said frame for accommodating said second bearing bar,;

b. a first pair of small openings having inner screw threads located on said frame adjacent to each end of said first elongated groove respectively for receiving a first pair of mounting screws, and a second pair of small openings having inner screw threads located on said frame adjacent to each end of said second elongated groove respectively for receiving a second pair of mounting screws; and c. a first pair of mounting ears extending respectively from the first and second ends of said first bearing bar each having a small opening, and a second pair of mounting ears extending respectively from the first and second ends of said second bearing bar each having a small opening;

d. whereby when said first bearing bar is adapted into said first groove on said frame, said small openings on said first and second mounting ears of said first bearing bar are aligned with said first pair of small openings on said frame, to thereby receiving said first pair of mounting screws for mounting said first bearing bar to said frame, and when said second bearing bar is adapted into said second groove on said frame, said small openings on said first and second mounting ears of said second bearing bar are aligned with said second pair of small openings on said frame, to thereby receive said second pair of mounting screws for mounting said second bearing bar to said frame.

7. A jewelry item comprising:

a. a frame having two arcuate transversal end portions, and a first elongated straight longitudinal side portion and a second elongated straight longitudinal side portion each having a first end and a second end, a first short transversal chamber adjacent to the first end, a second short transversal chamber adjacent to the second end, and an elongated straight longitudinal chamber extending from the first transversal chamber to the second transversal chamber;

b. a first elongated straight transversal turning bar and a second elongated straight transversal turning bar each having an elongated rectangular central portion with four decoration sides, a first short cylindrical end portion and a second short cylindrical end portion each further having a pair of oppositely disposed side detents corresponding to a respective pair of oppositely disposed decoration side of the central portion, oppositely disposed decoration sides of the central portion, where the pair of detents at the first end portion are offset with the pair of detents at the second end portion by ninety degrees;

c. a first pair of small regulating balls and a first elongated "U"-shaped biasing spring contained inside said longitudinal hollow chamber of said first side portion of said frame, and a second pair of small regulating balls and a second elongated "U"-shaped biasing spring contained inside said longitudinal hollow chamber of said second side portion of said frame; and d. said first end portions of said first and second turning bars inserted into said first and second transversal chambers of said first side portion of said frame respectively and contacting said first pair of regulating balls biased by said first biasing spring, and said second end portions of said first and second turning bars inserted into said first and second transversal chambers of said second side portion of said frame respectively and contacting said second pair of regulating balls biased by said second biasing spring;

e. whereby each turning bar can be individually rotated, and the rotation of an individual turning bar is halted when respective regulating balls are engaged to respective detents at the first and second end portions of the individual turning bar.

8. A jewelry item as described in claim 7 wherein said central portions of said first and second turning bars each has a first decoration side, a second decoration side, a third decoration side and a fourth decoration side, the respective first decoration sides of said first and second turning bars are decorated similarly, the respective second decoration sides of said first and second turning bars are decorated similarly, the respective third decoration sides of said first and second turning bars are decorated similarly, and the respective fourth decoration sides of said first and second turning bars are decorated similarly, so that a user can rotate said first and second turning bars to have a similar pair of sides exhibited for matching the user's outfit.

9. A jewelry item as defined in claim 8 wherein said four decoration sides of said central portions of said first and second turning bars have four different types of colors respectively.

10. A jewelry item as defined in claim 8 wherein said four decoration sides of said central portions of said first and second turning bars are decorated with four different kinds of gemstones respectively.

11. A jewelry item as defined in claim 7 wherein said frame is decorated with gemstones at the junctures of said first side portion and said first and second end portions and the junctures of said second side portion and said first and second end portions.

12. A jewelry item comprising:

a. a frame;

b. at least one elongated turning bar having a multiplicity of decoration sides and at least one group of detents located adjacent to one end of the at least one turning bar, each detent corresponding to a respective one of the multiplicity of decoration sides;

c. said at least one turning bar pivotally mounted on said frame;

d. means for regulating the rotation of said at least one turning bar including at least one biasing spring and at least one regulating object engageable to a respective one of said detents on said at least one turning bar; and c. said at least one regulating object being a small ball and said frame further having a widened chamber for housing said at least one biasing spring and the small ball;

f. whereby the rotation of said at least one turning bar is halted when said at least one regulating object is engaged to a respective detent on said at least one turning bar.

13. A jewelry item as described in claim 12 wherein each said decoration sides of said at least one turning bar is decorated differently so that a user can rotate said at least one turning bar to have a desired side exhibited for matching the user's outfit.

14. A jewelry item as defined in claim 13 wherein each of said multiplicity of decoration sides of said at least one turning bar have a different color.

15. A jewelry item as defined in claim 13 wherein each said multiplicity of decoration sides of said at least one turning bar are decorated with a different gemstone.

* * * * *